United States Patent [19]

Stone

[11] 4,358,217

[45] Nov. 9, 1982

[54] HIGHWAY TRAFFIC LANE AND ROAD EDGE REFLECTORS

[76] Inventor: Walter E. Stone, 450 E. 20th St., New York, N.Y. 10009

[21] Appl. No.: 133,108

[22] Filed: Mar. 24, 1980

Related U.S. Application Data

[63] Continuation-in-part of Ser. No. 17,188, Mar. 5, 1979, abandoned.

[51] Int. Cl.[3] ..... E01F 9/06

[52] U.S. Cl. ..... 404/16

[58] Field of Search ..... 404/16, 15, 14; 116/63 R; 350/97, 104

[56] References Cited

U.S. PATENT DOCUMENTS

| | | | |
|---|---|---|---|
| 1,822,916 | 9/1931 | Woods | 404/16 |
| 1,927,756 | 9/1933 | Ross | 404/16 |
| 1,955,478 | 4/1934 | Weber | 404/16 |
| 2,034,391 | 3/1936 | Hall | 404/16 |
| 2,073,166 | 3/1937 | Moorman | 404/16 |
| 2,108,370 | 2/1938 | Ernst | 88/79 |
| 2,126,224 | 8/1938 | Shaffer | 404/16 |
| 2,146,359 | 2/1939 | Shaw | 404/16 |
| 2,157,059 | 5/1939 | Rosener | 404/16 |
| 2,181,613 | 11/1939 | Stewart | 404/16 |
| 2,185,488 | 1/1940 | White | 404/16 |
| 2,242,619 | 5/1941 | Richardson | 404/16 |
| 2,245,336 | 6/1941 | Hamilton | 404/16 |
| 2,266,373 | 1/1941 | Mattson | 404/16 |
| 2,337,793 | 12/1943 | Abbott | 404/16 |
| 2,635,513 | 4/1953 | Batterson | 404/16 |
| 2,703,038 | 3/1955 | Shaw | 404/16 |
| 2,991,698 | 7/1961 | Leubaz | 88/79 |
| 3,240,132 | 3/1966 | Wiswell | 94/1.5 |
| 3,277,800 | 10/1966 | Wiswell | 94/1.5 |
| 3,319,542 | 5/1967 | Bergsnov-Hansen | 94/1.5 |
| 3,343,467 | 9/1967 | Bonvallet | 94/1.5 |
| 3,373,667 | 3/1968 | Meyers | 404/16 |
| 3,516,337 | 6/1970 | Gubela | 94/1.5 |
| 3,570,377 | 3/1971 | Gerber | 404/16 |
| 3,938,903 | 2/1976 | Montgomery | 404/16 |
| 3,980,410 | 9/1976 | Suhr | 404/16 |
| 4,008,973 | 2/1977 | Montigny | 404/16 |
| 4,088,416 | 5/1978 | Taylor | 404/15 |
| 4,155,666 | 5/1979 | Flanagan | 404/16 |

FOREIGN PATENT DOCUMENTS

| | | | |
|---|---|---|---|
| 651541 | of 1951 | United Kingdom | 404/16 |
| 666144 | of 1952 | United Kingdom | 404/16 |
| 786987 | 11/1957 | United Kingdom . | |

*Primary Examiner*—Nile C. Byers, Jr.

*Attorney, Agent, or Firm*—Brumbaugh, Graves, Donohue & Raymond

[57] ABSTRACT

Reflectors for indicating, for example, the dividing line between traffic lanes and road edges include an above-the-road housing portion that has a spherical contour rising gradually from the road in all directions. Impact, resistant solid metal shoulders have between them a light channel with divergent side walls and an upwardly and outwardly sloping upper surface. Bridges across the channel, from shoulder to shoulder protect reflective lenses from tires and lift narrow two wheel vehicle tires up and over the lenses. A removable assembly retains the lenses latched in place. Wash openings directly above the lenses expose the lenses to direct impact by rain and reservoirs collect water for splash washing. Bases for the reflectors can be surface mounted, imbedded for new road construction, or anchored by bolts in a shallow recess. Extension below the road surface level of the assembly retaining the lenses permits larger reflector lenses in the housing of the reflectors imbedded and bolted in a shallow recess. A removable model has a permanently secured base below road level with a detachable upper housing locked in place by a sturdy solid metal wedge between cooperating slots and lugs on the base and housing. This locking arrangement, the lens assembly retaining provision, and specially coded bolts securing the reflectors are vandal-resistant.

25 Claims, 13 Drawing Figures

FIG. 1
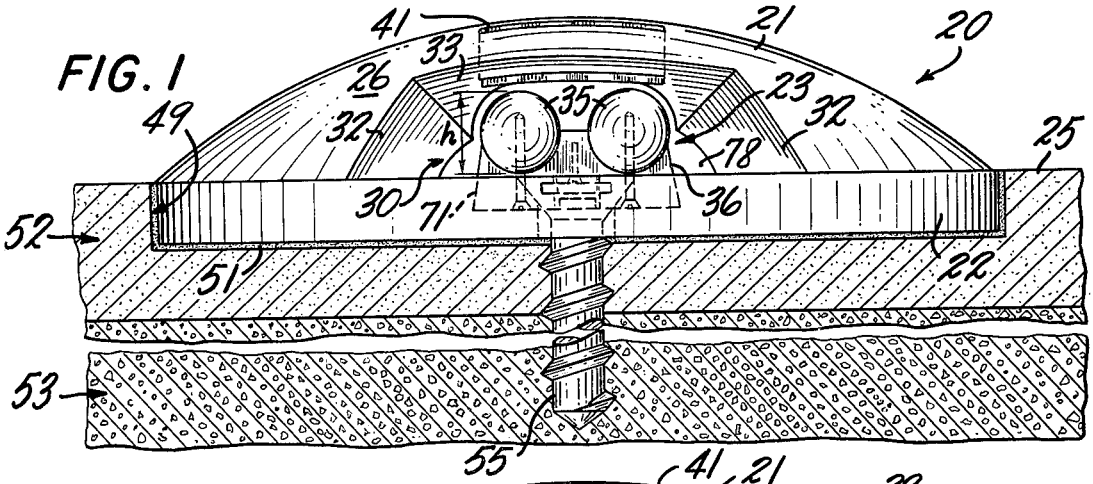
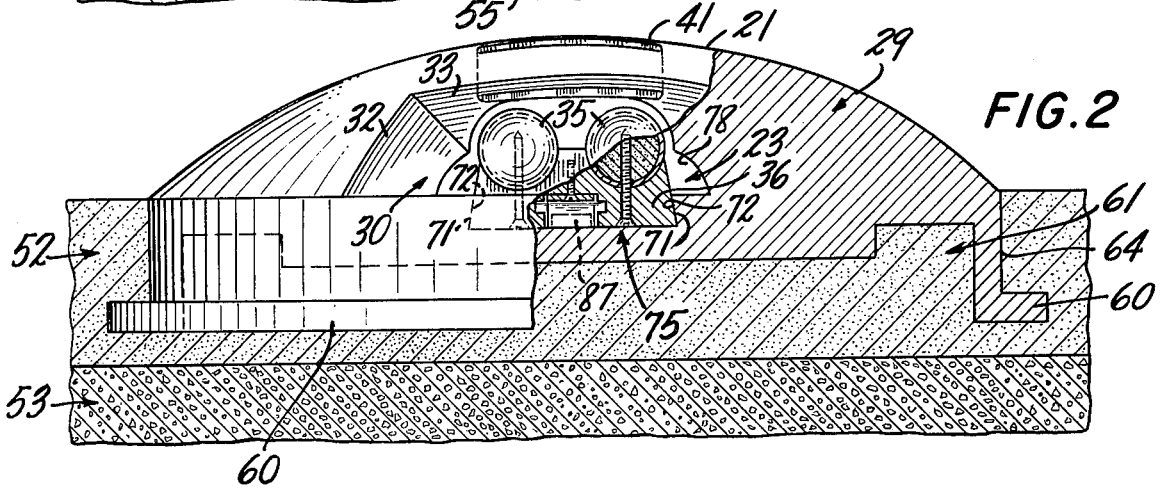
FIG. 2
FIG. 3
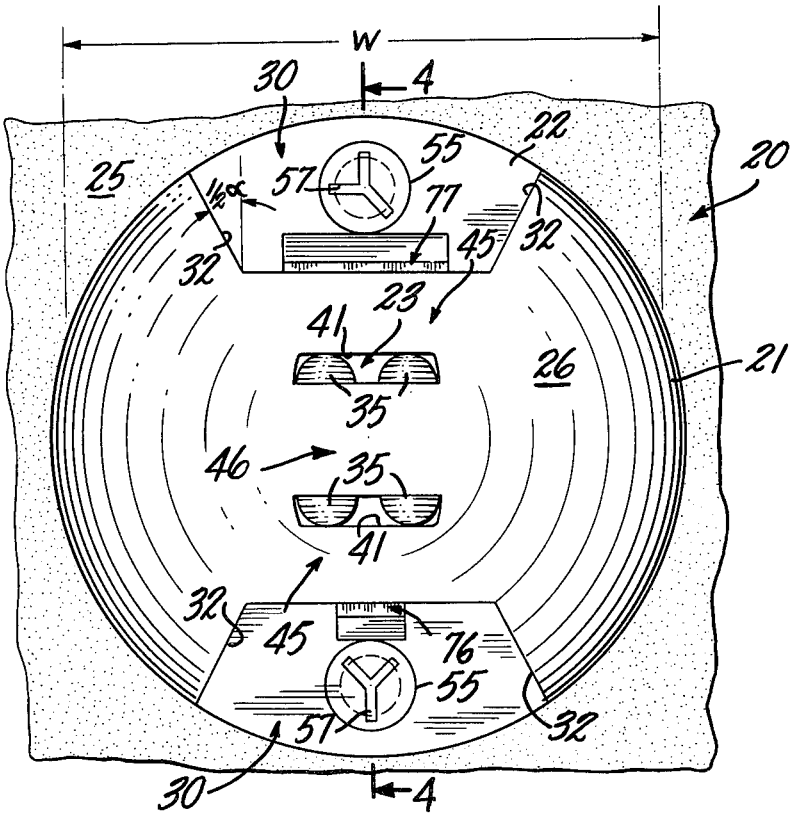

HIGHWAY TRAFFIC LANE AND ROAD EDGE REFLECTORS

This is a continuation-in-part of application Ser. No. 17,188, filed Mar. 5, 1979, now abandoned.

BACKGROUND OF THE INVENTION

1. Field of the Invention

This invention relates to reflectors for delineating, for example, highway traffic lanes and road edges, and more particularly to reflectors of the kind to be placed in spaced linear relationship along a highway traffic lane dividing line or along road edges or the like to assist the night driver.

2. The Prior Art

Throughout the history of motor vehicle travel over paved road surfaces, many reflective devices for traffic guidance have been devised. While it is true that these have included an acceptable or even advantageous feature here or there, no entirely satisfactory highway lane or road edge reflector has been proposed. This largely accounts for their absence from very many United States highways. Absent solutions to many of the disadvantages outlined below, it is expected that these devices will not gain the governmental approval necessary for their use in a consistent interstate system of reflector lane demarcations and warnings.

The prior art describes numerous reflectors that include housings to be secured to a road surface and to house reflective lenses therein. In some, the lenses are exposed to tires passing over the housing. This abrades the lenses with a resultant decrease in reflectivity. In others, the reflecting lenses are sufficiently deeply recessed within the housing to prevent this, but only a narrow channel or opening is provided for incident light to reach the recessed lenses and for reflected light to be returned to an oncoming vehicle. The result is the reflector can be seen through only a relatively narrow angle, and consequently, visibility of these reflectors down a highway curve is lessened. Likewise, if the angle upward of reflected light is restricted, the reflectors visibility in hilly terrain decreases. In other prior art reflectors, even those in which the reflective lenses are adequately recessed so as not to be abraded by the passage of tires over the reflector, the reflector housing are often hollow shells insufficient to withstand the abuse of high speed truck traffic, snow plow blade encounters, and the impact of a tire that skids into the housing rather than rolling over it.

Often in the housings of prior art reflectors, a gradual rise of the reflector housing from the road surface in the direction of traffic flow is afforded while, in the transverse direction, the reflector housing arises abruptly from the road. In such reflectors, no thought appears to have been given to the skidding of a two wheeled vehicle as a result of a tire's edge meeting an abrupt parallel ridge.

Some prior art reflectors give attention to cleansing the reflecting lenses. In one instance, rainwater is directed over the lenses, but rainwater incident on the reflector housing is made to flow along the housing surface through a channel and onto the lenses. No provision is made to permit falling rain to impact the reflector lens surfaces first and without any intervention or redirection of the rainfall so that the considerable force developed by the raindrop's earthward fall can contribute to the cleansing of a lens deeply recessed protectively in a housing.

In several instances, the prior art points to the considerable damage that snowplow blades do to reflectors. In no instance, however, is the suggestion made that snowplow impacting be entirely avoided by providing a reflector with a separate recessed base residing entirely beneath the road surface and an easy to remove upper housing that carries the reflective lenses. Where snowplow damage is particularly severs, then, removal of the upper housing throughout the snow season is the answer.

Often the reflectors of the prior art must extend well above the surface of the road to provide a reflector lens of adequate size. Lower reflectors may suffer from thinner, weaker housings or from lenses too tiny to be visible at any great distance.

Many of the reflectors suggested in the prior art lack protection from theft of either the entire reflector housing or the reflector lens elements and so are particularly vulnerable to vandals. Others suggested in the art appear to be insufficiently secured and thus easily, accidentally dislodged.

So, although a number of reflectors have been described in the prior art with one or more desirable characteristics, none, to this time, has provided the combination of features necessary to overcome the many failings outlined above.

BRIEF SUMMARY OF THE INVENTION

In accordance with this invention, highway lane divider and road edge reflectors are provided that have improved durability and visibility. The reflectors achieve these by a unique combination of characteristics that include a spherical contour that rises only gradually from the road surface in all directions, recessed reflector lenses protected by non-deformable solid shoulders and upper, structurally sound bridges that keep tires safely away from the lens surfaces, and cleansing provisions that afford, first, direct impact of rainfall onto the recessed lens surfaces, and, second, splash-washing from an internal water collection basin or reservoir. The reflector has a body whose entire outer surfaces, of that part that rises above the road surface level, comprising the shoulders and one or more bridges, have one continuous uninterrupted contour of a segment of a sphere.

Snowplows are recognized to have had disastrous affects on many prior art reflectors. The gradual rise of the instant reflector housing edges in all directions from the road surface diverts a snowplow blade wherever that blade may strike the housing. A tire of a heavily loaded truck rolling over or even skidding into the upper housing should not damage the reflector. the gradual rise in all directions has the further benefit of not interfering with the tracking of a two wheel vehicle. Durability results further from the solid metal shoulders on each side of the reflector's light channels being spaced apart less than the width of the smallest car tire. And the heavy duty bridges spanning a light channel above and in front of the reflectors, from shoulder to shoulder, lift narrower two wheel vehicle tires up and over reflector lenses while preventing these narrower tires wedging within the narrowing channel. Finally, the point of impact of tires meeting the reflector housing will always be on a strong thick metal housing portion, either a shoulder or a bridge.

Widely angled light channels into housings of reflectors according to the invention increase visibility through curves and in hilly terrain. A reflector base that is recessed into the road surface permits a full upper housing portion to be used to accommodate larger, more visible reflector lenses without compromising the solidity and structural integrity of the housing. Deep recessing of the lens elements within the rigid protective housing away from the abrading effect of tires passing over the housing improves visibility of the reflector over a longer period of time. A rainfall ingress wash opening aligned vertically with the lens surfaces permits the full force of cleansing rainfall to impact and wash the lens surfaces. Channels fully through the reflector housing, with water passage grooves past the reflective lenses and their mountings, permit the passage of surface waters without their accumulation such as would diminish visibility, and this surface water flow too can have a cleansing effect. Moreover, the shallow wash basins or reservoirs in the reflector housings accumulate water to be splashed across the reflector lens surfaces by, for example, the blast of air preceding a tire as that tire rides over the reflector housing.

Several alternative arrangements for fixing reflectors to the road are offered by this invention. For new road construction an embedded base allows placement of the reflector base permanently in place. For existing road surfaces, a bolted-in-place area requires only the formation of a shallow hole to locate the base. In this latter arrangement, vandal-resistant heavy duty bolts anchor the reflector to the road. Finally, a road surface mounted model, which is particularly amenable to road edge installation, is secured directly on the road surface by the heavy duty bolts or by an epoxy cement. The reflectors can be alternatively permanently located or removable. In removable models, the reflector's upper housing body is removable from the permanently in place base. This gives an extra measure of snowplow protection where snows are frequent. Again vandal-resistent connection means can include a wedge locatable between interlocking lugs and slots on the separable upper housing and base portions. A retaining leaf spring holds the wedge in place, and a threaded bore and retraction tool allow the authorized workman to withdraw the wedge. This locking arrangement affords the additional benefit of providing a substantially solid intervening block of metal between cooperating lugs and slot ends that must be rotated relative one another if the upper housing portion is to be removed. Vehicles engaging the upper reflector housing portion will not rotate that portion so as to accidentally loosen the exposed reflector housing.

The reflectors according to the invention include a reflector lens assembly that can be completed as a unit and quickly and easily installed in the housing with the lens surfaces vertically aligned with the rainfall ingress wash openings and substantially immovably positioned for correct reflective action via the light channels in the housing. A novel spring biased retention arrangement and a keyway-fitting insertion tool permit the easy and accurate location and authorized removal of the reflector lens assembly. Easy removal provides for replacement of the reflector lenses without removing the entire reflector. A workman with the correct tool inserts that tool in a keyway to force a retainer spring out of blocking association with a projecting part of the reflector base. Again, this arrangement affords vandal-resistance in that the manner of removing the lens assembly is not all that apparent and the correct tool is needed.

A road edge embodiment can have a higher profile than reflectors for highway lane separation. At the road edge, snowplow damage should not occur, fast moving two wheel vehicles should not hit the reflectors, and the slightly higher profile can audibly alert drivers drifting to the road shoulder. The reflector lens assemblies of these road-edge reflectors, with reflector lenses facing in just one direction, can be moved slightly farther back within the housing with respect to the central axis. This permits greater space for a thickened central protective bridge. So, without recessing into the road, the road edge reflectors can provide substantially larger reflector lenses and an equally rigid protective housing.

The reflectors of this invention, with their easily removed and replaced lens assemblies are particularly useful in a system of danger and caution alerts. It is envisioned that road edge reflectors with lens elements reflecting red light to the driver can be used to signal the drivers approach to particularly hazardous locations. A prime example is the approach of a bridge or overpass abutment adjacent the lane. Amber caution reflector lenses can be used in advance of a danger area or to signify relatively sharp bends, intersections, or the like. Consistently used, such a system should afford a considerable safety factor, particularly in previously accident-ridden locations.

From all the foregoing, and from the subsequent description of preferred embodiments, it will be seen, then, that the reflectors according to this invention are versatile, durable, highly visible and safe. The above and further features of the invention will be better understood from the following detailed description and the several views of the attached drawings.

BRIEF DESCRIPTION OF THE DRAWINGS

In the drawings:

FIG. 1 is a front elevational view of a reflector according to this invention, and shows a reflector secured by heavy duty bolts to a road construction, indicated in section.

FIG. 2 is a rear elevational view of a further reflector embodiment with parts broken away for clarity and showing a reflector base portion adapted for embedding in new road construction, the road construction being shown in section.

FIG. 3 is a top plan view of the reflector of FIG. 1 and shows more clearly a pair of rainfall ingress wash openings vertically aligned with the surfaces of the reflector elements.

DESCRIPTION OF PREFERRED EMBODIMENTS

Figure 4:
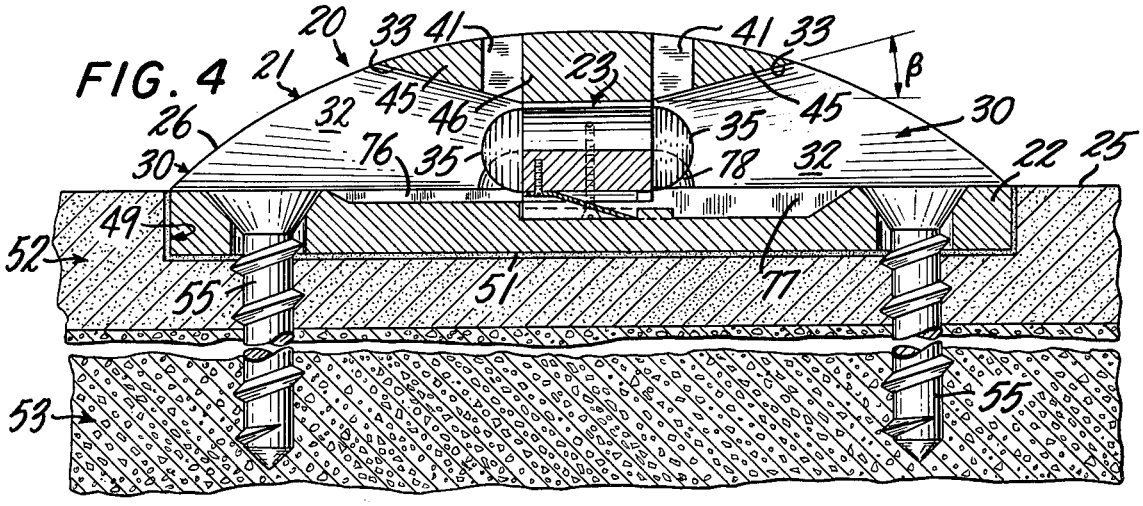
FIG. 4 is a cross-sectional view taken along the lines 4—4 of FIG. 3 and shows the bolted-in-place reflector with aligned rainfall wash holes, light channels, and leaf spring retainer.

As seen in FIGS. 1, 3 and 4, a reflector 20 includes an upper housing portion 21, a lower base portion 22, and a reflector assembly 23 supported on the base portion and protectively enclosed in the housing portion. The reflector 20 of FIG. 1 is particularly suitable to demark the division between lanes of a highway. As currently envisioned, the reflector has a diameter of about 5½ inches and a height of about 1 inch above a road surface 25. The upper housing 21 forms a body whose entire outer surfaces 26, of that part of the body that rises above the road surface level, comprising shoulders and one or more bridges, have one continuous uninterrupted contour of a segment of a sphere that rises gradually in every direction from the plane of the road surface 25, where the upper housing portion meets the base portion 22.

The reflector 20 has a light channel 30 extending through the reflector from front to back. The channel has divergent side walls 32 that spread angularly apart from near the reflector assembly 23 to the outer housing surface 26 where the channel opens out from the reflector. The channel has an upper surface 33 inclined upwardly away from the reflector assembly 23, again to the outer surface 26. The reflector assembly 23 is mounted in the light channel and includes four reflective elements 35 secured to a support 36 and described in greater detail below. Suffice it to say at this point, the reflective elements or lenses 35 are relatively large, having a height H that extends substantially the entire distance from the plane of the road surface 25 to the upper surface 33 of the channel 30.

Aligned directly upwardly with respect to the surfaces of the reflective elements 35, a pair of rainfall ingress wash openings 41 communicate vertically between the light channel 32 and the exterior of the housing portion 21 of the reflector.

The upper surface 33 of the light channel 30 is formed by an under surface of one of a pair of bridges 45 that extend across the light channel forward of and above the pairs of reflective elements. A third, central bridge 46 spans the channel above the reflector assembly 23.

In the embodiment of FIGS. 1 and 3, the base 22 is adapted for use with previously paved roads. In FIG. 1 the base 22 is positioned in a shallow recess 49. A sealant 51 may be employed to fill any slight gap between the base and the recess. The shallow recess 49 is formed in an upper surface 52 of asphalt or the like that overlays a foundation layer 53 of concrete. The shallow recess 49 is formed in a suitable fashion, as by drilling, for example. With the base 22 set in place, a pair of strong threaded anchor bolts 55 are driven into the road. The bolts 55 have heads countersunk in conforming holes in the base and are, preferably, provided with an especially formed slot configuration such as the Y-shaped slots 57 shown in FIG. 3.

In the embodiment of FIG. 2 like numerals designate like parts. The upper housing portion 21, the reflector assembly 23, the light channel 30, the rainfall ingress wash openings 41 are all identical to those of FIGS. 1 and 3. The base, however, includes an outwardly turned lip 60 and an upwardly extending central cavity 61. The reflector of FIG. 2 is an embodiment designed for use in new road construction. Before installation in a road surface under construction, cavity 61 may be filled with cement and given a drying period of several days. This work is done in the shop before delivery to the construction site. The upper layer 52 of asphalt reaches an outer cylindrical surface 64 of the reflector base portion. It overlies the lip 60, and secures the reflector in place.

As can be seen more clearly in FIG. 2, the support 36 of the reflector assembly 23 has outwardly inclined sides 71. These interfit similarly inclined side edges 72 in the central portion of a recess 75 that receives the lower extent of the support 36. The interfitting sides of the recess and the support prevent all vertical and sideways horizontal movement of the assembly and align the reflector elements 35 with the light channel 30. The recess 75, it can be seen, in the embodiment of both FIGS. 1 and 2, is below the plane of the surface of the road. This permits the full distance from the road surface to the upper surface 33 of the light channel 30 to be used for housing an enlarged reflector element to very greatly increase the amount of light reflected from the reflectors. The larger reflective element surface area that results means that more light is incident on a reflective element, more light is therefore reflected, and the reflector is more visible and at a greater distance.

The visibility of the reflectors is further increased by the wide angle of divergence of the side channel walls 32. These diverge by an angle $\alpha$ of approximately 45° or more, which appreciably increases lighting of the reflector elements 35 through curves in a highway where ordinarily misalignment of an approaching automobile's headlights and the light channel would result in little or no reflection. Likewise, the upper surface 33 of the channel 30 is inclined up, outward and away from the reflective elements at an angle $\beta$ of approximately 10° or more, as shown in FIG. 4, to greatly increase the angle through which light may be directed to and reflected from the reflective elements or lenses 35 in hilly terrain or where the reflectors are mounted on old and uneven road surfaces.

In the reflectors as described thus far, increased visibility over a prolonged period is contributed by a combination of features. The surfaces of the reflective elements 35 are regularly cleansed. First, the rainfall ingress wash openings 41 through the housing in direct vertical alignment with the surfaces of the reflective elements assures that the considerable force gathered by raindrops as they fall is not diverted when they directly enter the openings 41. This force, then, is put to good use, scrubbing clean the surfaces that have accumulated dust, road grime, mud, or the like. The force of that directly impingent raindrop is easily recognized by anyone who has observed the diameter of the splashes, on a city sidewalk, of the first drops of a heavy shower.

Further washing can result from the collection of rain or surface waters in basins or reservoirs 76 and 77, that are part of the recess 75 best seen in FIG. 4. A tire of a vehicle moving at fifty or more miles per hour and suddenly "capping" the channel opening in front of the reservoir 77 will blast air into the channel 30 and likewise blast water up and out of the reservoir across the surfaces of the reflective elements 35. On the other hand, surface waters, rain and the like, if they entirely fill either end of the channel 30 would reduce the reflector's visibility. For that purpose, surface water bypass grooves 78 are provided on each side of the reflector assembly 23. On hills, in particular, the flow of surface waters into the reflector results in all but the lower recesses being quickly emptied.

The replaceable nature of the reflector assembly increases the useful life of the reflector, assuring its visibility from year to year. Surface water carrying abrasive grit or the like can, over a period of time, result in a deterioration of the surfaces of the reflective elements 35. The reflector assembly can be easily dislodged and replaced without disturbing the reflector itself.

Figure 5:
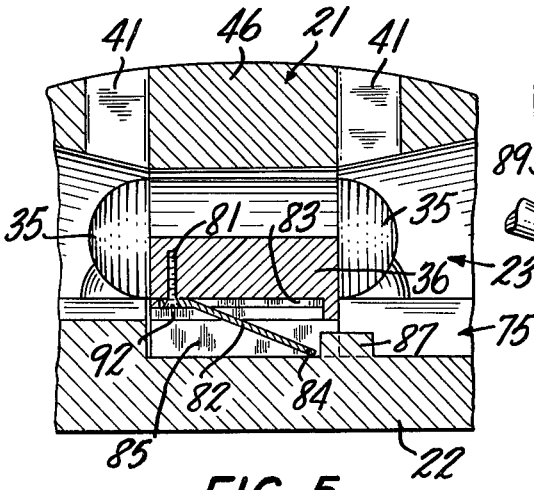
FIG. 5 is an enlarged fragmentary cross-sectional view better illustrating the reflector assembly and the cooperation of the reflector support mounted spring retainer and cooperating projection on the base of the reflector.
Figure 6:
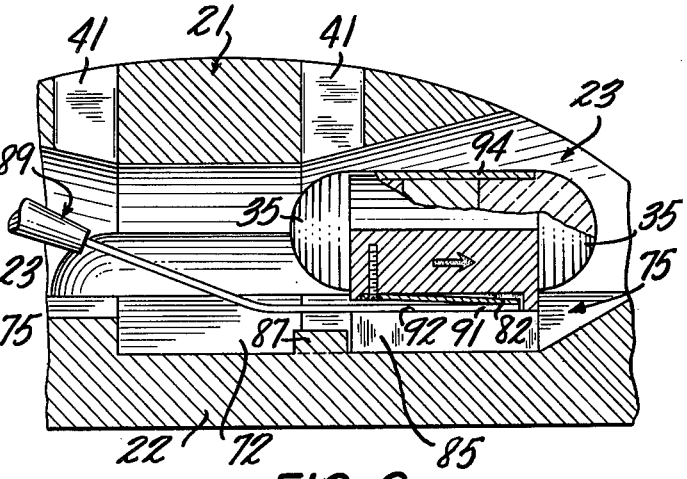
FIG. 6 is a further enlarged fragmentary cross-sectional view like that of FIG. 5 and shows the reflector assembly being removed from its retained position in the housing.
Figure 7:
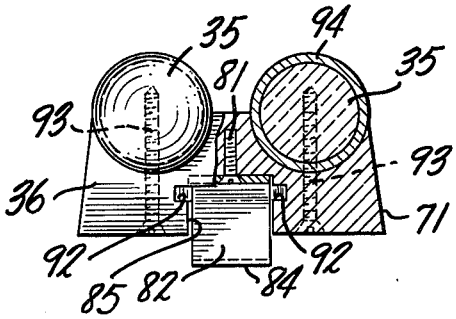
FIG. 7 is an enlarged elevational view partly in section of the reflector assembly showing the reflective elements, support, and retainer spring.

Turning to FIGS. 5, 6 and 7, these show, in more detail, the means by which the reflector assembly 23 is retained releasably in the housing 21. In FIG. 5, the reflector assembly 23 is seen fully inserted beneath the central bridge 46. A screw, pin or other suitable fastener 81 secures a retainer spring 82 in a slot 83 in the bottom of the support 36. The spring 82, a leaf spring, is bent slightly between its mounted end and its free end so that the free end 84 has a natural unbiased location lower than the bottom surface of support 36, as best seen in FIG. 7. In the recess 75, a latching projection 87 extends upwardly from the floor of the recess. This latching projection 87 fits within the lowermost slot portion 85, that extends the entire length of the support. When inserted, as shown in FIG. 5, the reflector assembly 23 latches in place by virtue of the free end 84 of the retainer spring 82 snapping over the projection 87 and into abutting relationship with that projection to prevent removal of the reflector assembly. The locking in place is both automatic and instantaneous.

Removal of the reflector assembly 23 utilizes a tool 89 that ends in a key 91 dimensioned to fit a keyway 92 just below the level in the slot 83 at which the secured end of the retainer spring 82 is affixed. As illustrated in FIG. 7, the keyway 92 includes a pair of outwardly, transversely extending grooves on each side of the slot 83. The key 91 of the tool 89 extends across the slot and fits into the grooves. When forced into the grooves against the spring 82, the key 91 forces the spring up and into its receiving recess just above the keyway. Continued pushing of the tool 89 in the direction of the unnumbered arrows in FIG. 6 results in the forward movement of the reflector assembly 23 past the latching projection 87, and the assembly 23 is freed for removal from the housing 21. Because the manner in which the reflector assembly 23 is latched into place in the housing 21 is not all that apparent, and because only an appropriately dimensioned key 91 will suffice to unlatch the spring 82 and the projection 87, the reflector assembly is resistant to removal by vandals.

As for the construction of the reflective elements 35, the preferred material is glass, this being more abrasion resistant, although a plastic would suffice, but could result in the need for replacement of the assembly 23 more often. The reflective elements 35 are secured in the assembly 23 by a small tube 94 of 0.017 inches thick copper or the like. This has a central fill between rear silverized surfaces of the two reflectors 35 to form a subassembly that is secured, as by the screws 93, to the support 36.

Figure 8:
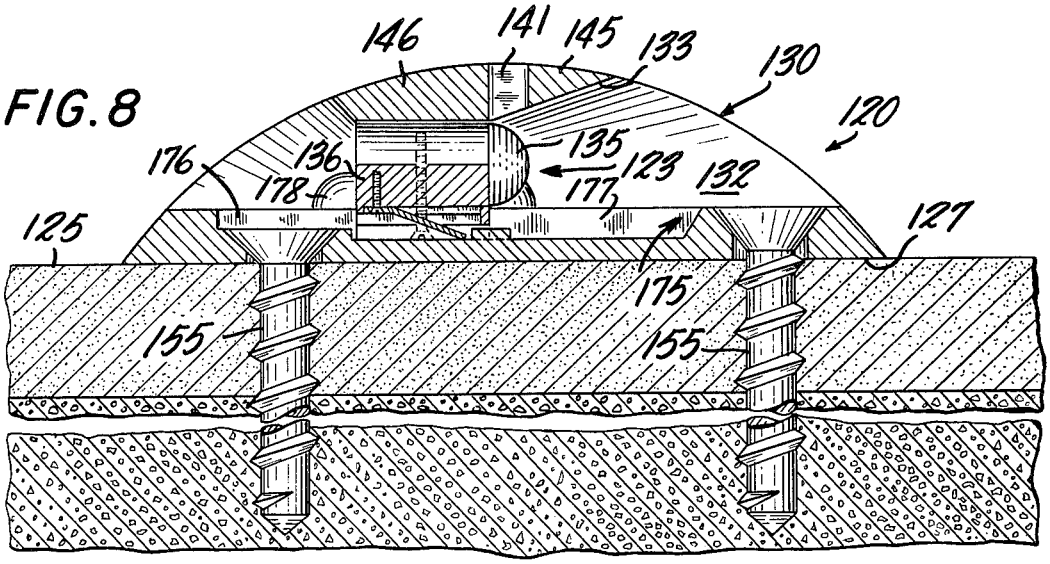
FIG. 8 is a cross-sectional view of a road edge reflector secured to the surface of a road, and having reflective elements for reflecting light in one direction only.

FIG. 8 illustrates a road edge reflector 120 having a somewhat higher profile than the lane divider reflectors of FIGS. 1–4. The road edge reflector 120 is surface mounted having its bottom planar surface 127 resting on an upper road surface 125. Heavy duty, countersunk, threaded bolts 155 secure the reflector 120 in place in the preferred FIG. 8 embodiment, but if desired, as in any of the bolted-in-place reflector bases, any of the high strength new-technology adhesives can be used, particularly where little or no abuse of the reflector is to be encountered.

Because the road edge reflector of FIG. 8 is surface mounted, the recess 177 that receives the lower portion of a support 136 cannot be below the surface of the road, nor can any portion of a unidirectional reflector assembly 123 be so located. The reflector 120, therefore, extends somewhat higher, having a height of approximately $1\frac{1}{4}$ inches. The reflector assembly 123 is located slightly rearward of the reflector's center line. This provides sufficiently deep recessing of the reflector elements 135 and allows sufficient space near the reflector's center line for the construction of a rigid, thick, metal bridge 145.

In this embodiment, too, divergent side surfaces 132 of a light channel 130 give good, wide angle visibility. An upwardly sloping top light channel surface 133 formed on the under side of the bridge 145 gives similar results as described with respect to the lane dividing reflectors in hilly terrain and on uneven road surfaces. Washing is provided with a single rainfall ingress wash opening 141 and basins or reservoirs 177 to accumulate water for splash washing.

Grooves 178 bypass the reflector assembly 123 to permit flow through of surface waters. The latching arrangement of the reflector assembly 123 is like that described above. So, it will be seen, the road edge reflector provides many of the advantages described with regard to the lane divider reflectors. Whereas the low profile, and gradual rise in all directions from the road surface of the reflectors of FIGS. 1 through 4 resists snowplow damage, reduces the likelihood of those reflectors' affecting the tracking of two wheel vehicles, the increased height of the road edge reflector of FIG. 8 is acceptable by virtue of its ordinarily being located out of the path of a snowplow blade and where two wheel vehicles should not be encountered at any substantial speed. In diagonal snow cleaning operations, the trailing ordinarily right-hand part of the snowplow blade could not do any damage. It would be lifted up and over the reflector body. Moreover, this surface mounted road edge reflector has the additional advantage, from its increased height, of providing a louder audible alert to the driver wandering off the road. Of course, if more compelling reasons demand, road edge reflectors can be provided with bases like those shown in FIGS. 1 and 2.

In strength and durability, both the lane divider and road edge reflectors are similar. To each side of the light channel through these reflectors' housings, solid metal shoulders 29, best illustrated in FIG. 2, provide virtually indestructible protection to the reflector assembly. The bridges 45, 46 and 145, 146 in FIGS. 1 through 4 and 8 are thick, structurally sound integrally formed spans that lift a narrow, two wheel vehicle tire up and over the reflector assembly. They prevent the edge of a wider vehicle tire protruding into the area of the reflective element, and they prevent the narrower two wheel vehicle tire from wedging into the light channel which severely narrows as it approaches the reflective elements. In FIG. 3 a width W is shown that is the width of the narrowest automobile tire, approximately four inches. From this it can be seen that even the narrowest automobile tire is lifted gradually up and over the reflector irrespective of its impacting the reflector directly at the opening of the light channel 30. However a vehicle wheel strikes the reflector, its location of impact will be met by the solid metal of either the shoulders or the bridges.

Figure 9:
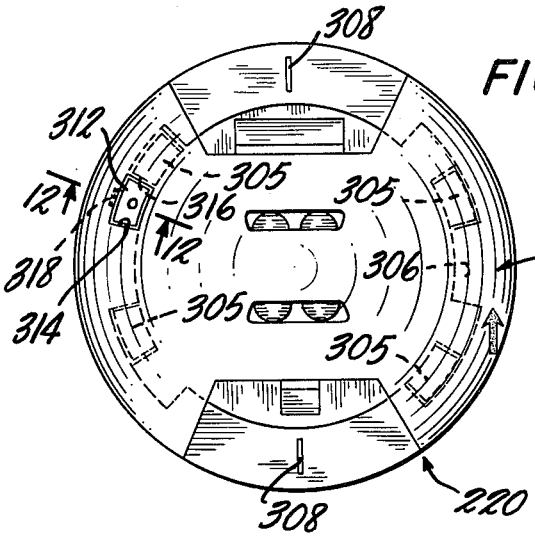
FIG. 9 is a top plan view of a reflector having a removable upper housing secured to a permanently in placed base.
Figure 10:
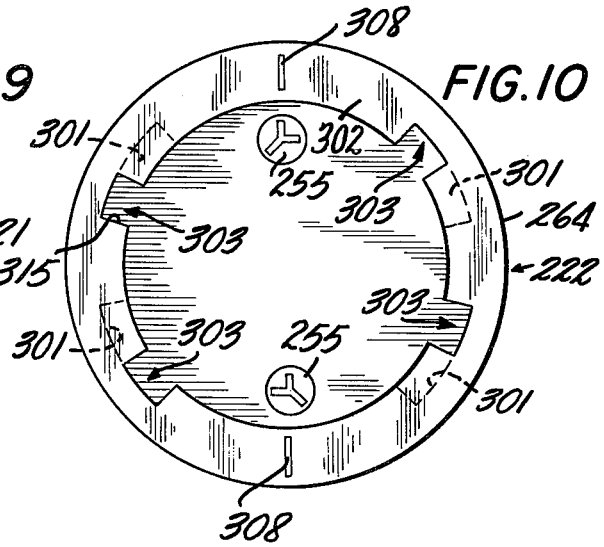
FIG. 10 is a top plan view of the base of the reflector of FIG. 9.

In FIGS. 9 and 10, a reflector 220 is shown that has a housing portion 221 that is entirely removable from a reflector base. In regions having the severest winter conditions, it is anticipated that even the abuse resistant reflectors described above may not be approved, particularly if past experience has resulted in local governmental bodies' general disapproval of reflectors. Complete removal of all reflector parts extending above the road surface will permit repeated plowing throughout the winter season and reattachment of the upper reflector portions in the spring. The housing 221 and the base 222 are provided, therefore, with complementary connection means. Turning first to the base, arranged along a circle interior of the outer periphery 264, a series of slots 301 formed beneath an inwardly extending flange 302 have openings 303 at their ends.

The openings 303 receive lugs 305 on the upper housing portion 221 extending radially outwardly from a cylindrical surface 306 thereon. With the lugs 305 in the openings 303 and the upper housing 221 resting on the lower base 222, the upper housing is turned clockwise bringing the lugs to the other end of the slots 301 underlying the flange 302. A pair of index marks 308 assist correct orientation of the reflector with respect to oncoming vehicles.

Figure 11:
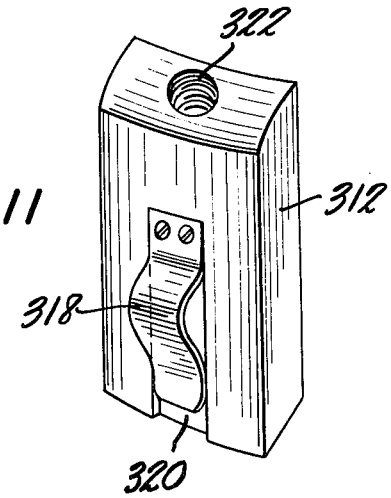
FIG. 11 is an enlarged perspective view of a blocking wedge for insertion in the reflector of FIGS. 9 and 10 to lock the housing to the base.
Figure 12:
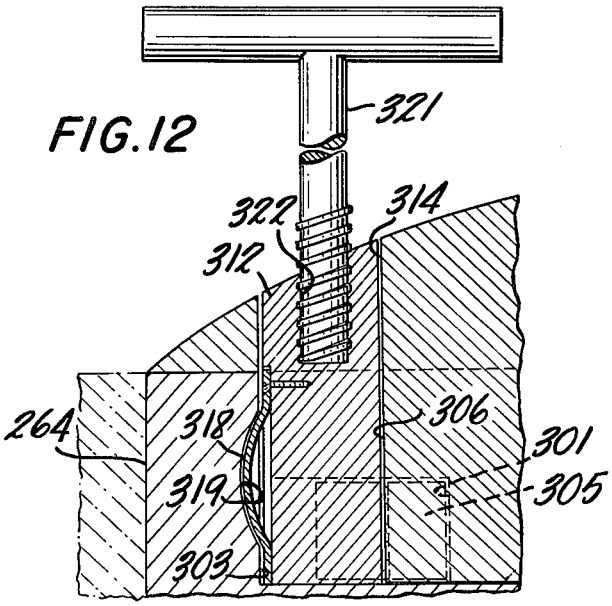
FIG. 12 is an enlarged fragmentary cross-section view taken along the line 12—12 of FIG. 9 and shows the wedge placed in the reflector between one of a set of interlocking lugs and slots.

Finally, with the two separable portions of the reflector 220 properly fitted together, a locking wedge 312 prevents removal of the upper housing portion accidentally or by vandals. The wedge 312 is inserted into an opening 314 in the upper housing. When the housing and base are correctly aligned, the opening 314 is aligned with an opening 303 at the end of the slot 301. The wedge 312 is then wedged in locking engagement between an end wall 315 of the slot 301 and a side surface 316 of a lug beneath the flange 302. FIG. 11 better illustrates the details of a leaf spring 318 that holds the wedge 312 securely in the slot opening 303. As can be seen in FIG. 12, with the wedge in place, the spring 318 firmly engages a cavity in the side wall 319 of the opening 303 to resist removal of the wedge. There being no easily graspable portion of the wedge 312 exposed, this locking arrangement is vandal-resistant.

A tool 321 for the retraction of the wedge 312 is shown in FIG. 12. The tool 321 threads into an opening 322 in the wedge top. Matching, unconventional threads can be used as a further assurance against unauthorized removal of the wedge. Upon retraction, the wall of the opening 314 depress the spring 318 into a track 320 on the wedge.

Other locking arrangements to prevent the upper housing portion being rotated and removed can easily be envisioned. However, the wedge described and shown in FIGS. 9 through 12 is an extremely durable arrangement in that it interposes solid metal between solid metal parts that must rotate relative one another for removal. A vehicle, it should be remembered, rolling, or even more severely, skidding into the reflector 220 in the direction of the unnumbered arrow in FIG. 9 can exert a huge rotational force upon the upper housing portion 221 of the reflector. Without this interpositioning of solid metals between lug and slot ends, accidental removal of the upper reflector portion can be the result.

Figure 13:
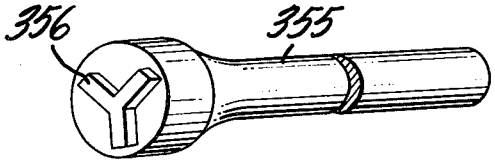
FIG. 13 is an enlarged perspective view showing a coded bolt intallation and retraction tool for cooperation with specially coded heads of the heavy duty bolts securing the anchored-in-place reflectors.

As with the other bolted-in-place embodiments, the heads of the bolts 255 can be provided with vandal-resistant coded slots such as the Y- slots of FIG. 10. And in FIG. 13, a tool head 355 is illustrated with a conforming Y-shaped projection 356 suitable to drive or remove the heavy duty bolts of this and the above embodiments. In each of the embodiments, the under surface of the base can be sharply notched in a pattern across its surface to better adhere to asphalt, sealant or adhesive.

Whereas preferred embodiments of the invention have been described, further variations will be apparent to those skilled in the art without departure from the spirit and scope of the invention, as defined in the appended claims.

I claim:

1. A highway reflector including a housing, a light channel opening into the housing, a reflective element in the channel and a base portion, said base portion comprising a central recessed area receiving mounting means for the reflective element, said recess extending below the surface of the road when said reflector is in use, a bridge including a relatively thick central span bridging the channel and forming the uppermost surface of the reflector, and said reflective element having a height such that the reflective element extends substantially the entire distance from the road surface level to the under-surface of the central span, and said mounting means for the reflective element extending into the recess below the road surface plane, said channel opening entirely through the housing at road level from front to back to permit the passage therethrough of surface water.

2. A reflector according to claim 1 further comprising:

a solid metal shoulder portion on each side of the channel.

3. The reflector according to claim 1 wherein said channel increases in width from the reflective element towards an exterior end thereof having a maximum width less than the width of the narrowest automobile tire, and the bridge is located intermediate the wider channel exterior end and the reflective element so as to intercept and prevent wedging of a narrower two wheel vehicle tire.

4. A reflector according to claim 1, further including:

washing means for the reflective element including a rain ingress wash opening directly above the front surface of the reflective element and providing a direct vertical path free of any intervening member for direct impact washing of the surface of the reflective element by falling rain.

5. In a reflector of the kind to be placed between highway traffic lanes and at road edges and the like for traffic guidance by light reflected therefrom; the improvement comprising:

a housing rising gradually from a location about the perimeter of the housing where, in use, said housing intersects the road surface, at least one reflective element recessed within the housing, a light channel opening from the exterior of the housing to the reflective element, the housing having a shoulder on each side of the channel, a bridge spanning the channel; and a base portion adapted for location below the surface of a road, said base portion having a recess therein, the reflective element including a mounting means extending below the reflective element into the recess, means located entirely below the road surface cooperating between the recess and the mounting means, for locking the reflective element and mounting means in place and the reflective element having a height extending substantially the entire distance from the plane of the road surface to an under-surface of the bridge.

6. The reflector according to claim 5, wherein said recess includes a reservoir in the floor of said channel and having at least a portion thereof forward of the front surface of the reflective element, for splash-washing the reflective element when a tire air blast enters the reflector at the outer end of the light channel.

7. The reflector according to claim 5, said housing further including water by-pass grooves, located laterally outwardly alongside the reflective element and mounting means for directing surface water entering the light channel past the reflective element.

8. In a reflector of the kind to be placed between highway traffic lanes and at road edges and the like for traffic guidance by light reflected therefrom; the improvement comprising:

an upper housing, a lower base, a reflector assembly insertable and removable as a unit protectively recessed within said housing in a light channel opening thereto and including at least one reflective element and a support therefor, and interfitting means on the interior of the light channel and the support for securing the reflector assembly removably in place, said interfitting means including means slidably receiving the support.

9. The reflector according to claim 8 for reflecting from one side of the housing only, wherein the bottom of said housing is planar and is adapted for securing to the surface of the road, the reflective element being located substantially at a central axis of the housing, reflective element mounting means located primarily on the other side of the central axis from the light channel, and a substantial portion of said a bridge being located over the channel on the opposite side of the central axis from the mounting means.

10. The reflector according to claim 8, wherein said light channel has side walls diverging outwardly from the reflective element to the housing outer surface by an angle of greater than approximately 45°.

11. The reflector according to claim 10, wherein the light channel has an upper surface formed by the bridge across the channel and diverging upwardly from the reflective element and forward thereof to the housing outer surface at an angle of greater than approximately 10°.

12. The reflector according to claim 8, wherein the support has side walls inwardly and upwardly inclined and engaged and held by inwardly upwardly inclined side walls of a pair of walls in said light channel, a projection locating the reflector assembly longitudinally of the light channel and spring biased locking means for locking the reflector assembly in place.

13. In a reflector of the kind to be placed between highway traffic lanes and at road edges and the like for traffic guidance by light reflected therefrom; the improvement comprising:

an upper housing, a lower base, a reflector assembly protectively recessed within said housing in a light channel opening thereto and including at least one reflective element and a support, and interfitting means on the interior of the light channel and the support for securing the reflector assembly removably in place, the base being integral with the housing and adapted to be bolted to the road, and including at least one elongate bolt having a head with coded drive provisions thereon adapted for driving engagement by a cooperatively coded drive tool, whereby said bolt resists unauthorized removal of the reflector.

14. The reflector according to claim 13, wherein the head of said bolt is provided with Y-shaped slots adapted to receive a tool having cooperatively Y-shaped projections thereon.

15. In a reflector of the kind to be placed between highway traffic lanes and at road edges and the like for traffic guidance by light reflected therefrom; the improvement comprising:

an upper housing, a lower base, a reflector assembly protectively recessed within said housing in a light channel opening thereto and including at least one reflective element and a support, and interfitting means on the interior of the light channel and the support for securing the reflector assembly in place, and the reflector assembly being accessible through the light channel communicating from the housing exterior to the at least one reflective element, an elongate recess formed in the floor of the light channel, said reflector assembly support fitting in sliding relation into said recess, a slot in the under side of said support, a downwardly biased leaf spring secured in the slot, a projection extending upward from the bottom of the recess and located to be abutted by the end of the leaf spring to prevent removal of the reflector assembly.

16. The reflector according to claim 15, wherein the reflector assembly support includes a keyway below the level at which the spring is secured to the support and at a height higher than the height of said projection, whereby a key can be inserted in said keyway to force the spring up and out of abutting engagement with the projection for removal of the reflector assembly.

17. A reflector assembly for use in a reflector of the kind to be placed between highway traffic lanes and at road edges and the like for traffic guidance by light reflected therefrom; the reflector assembly including at least one reflective element, a support affixed to the reflective element, the support having side walls adapted to retain the reflector assembly in place, a slot in one surface of the support, a leaf spring affixed to the support within the slot, a projecting portion of the leaf spring having an unbiased condition wherein the projecting portion extends outwardly of the location at which the leaf spring is secured to the support, and said downwardly projecting portion being movable inwardly against the bias of the leaf spring, whereby, in use, said leaf spring portion moves into blocking relationship with a projection in a reflector to hold the reflector assembly against removal.

18. The reflector assembly according to claim 17 further including a keyway comprising a pair of grooves extending laterally outwardly from the slot intermediate the location at which the spring is affixed to the support at the slot bottom and said surface in which the slot is formed, whereby a key inserted in said keyway forces said projecting portion of the spring deeper into the slot to move said projecting portion out of its blocking disposition.

19. The reflector assembly according to claim 18, wherein the keyway communicates with one end only of the support, the projecting portion of the spring is a free end thereof inclined away from the one end of the support so that insertion of a key in the keyway forces the free end more deeply into the slot and out of its blocking disposition.

20. In a reflector of the kind to be placed between highway traffic lanes and at road edges and the like for traffic guidance by light reflected therefrom; the improvement comprising:

an upper housing unit gradually rising from a location about the perimeter of the housing unit where, in use, said housing unit intersects the road surface, a light channel opening into the upper housing unit, a reflector assembly secured in the light channel, a lower base unit adapted to be secured to the road and located entirely at or below a level substantially flush with the surface of the road, means detachably connecting the upper housing unit and the lower base unit and adapting said upper housing unit for repeated seasonal removal to leave the roadway free of residual parts protruding substantially above the road level;

said upper housing unit and lower base unit forming a binary system of two separable unitary parts; whereby removal of the housing unit effects removal of the reflector assembly and all parts of the reflector substantially above the road level.

21. A reflector according to claim 20, wherein one of said housing and base portions units includes plural lugs extending from a circular wall thereof, and the other of said housing and base portions units includes cooperating circularly arranged slots larger than said lugs and having openings for receiving the lugs, whereby said reflector is assembled by placing the lugs in the lug receiving openings and turning the housing portion relative to the base portion unit.

22. The reflector according to claim 21, wherein the base portion unit has a circular peripheral outer wall and said lugs and slots are circularly arranged inwardly of the outer wall.

23. The reflector according to claim 20 including means removably securing the reflector assembly to the housing unit, first locking means for preventing unauthorized removal of the housing unit from the base unit and second locking means for preventing unauthorized removal of the reflector assembly from the housing unit.

24. In a reflector of the kind to be placed between highway traffic lanes and at road edges and the like for traffic guidance by light reflected therefrom; the improvement comprising:

an upper housing portion gradually rising from a location about the perimeter of the housing portion where, in use, said housing intersects the road surface, a lower base portion adapted to be secured to the road, and means detachably connecting the upper housing portion and the lower base portion, one of said housing and base portions including plural lugs extending from a circular wall thereof, and the other of said housing and base portions including cooperating circularly arranged slots larger than said lugs and having openings for receiving the lugs, whereby said reflector is assembled by placing the lugs in the lug receiving openings and turning the housing portion relative to the base portion, the base portion having a circular peripheral outer wall and said lugs and slots being circularly arranged inwardly of the outer wall, the slots extending circularly beyond the lug openings, said lugs when located in the slots with said housing portion turned in locked relation leaving at least one accessible portion of a lug opening, a locking wedge being dimensioned to fit said open portion and prevent return rotation of the housing.

25. The reflector according to claim 24, wherein the wedge includes spring biased retention means for holding said wedge in place within the open portion of the lug opening, and means for receiving a retraction tool for withdrawal of the wedge.

* * * * *

UNITED STATES PATENT AND TRADEMARK OFFICE

CERTIFICATE OF CORRECTION

PATENT NO. : 4,358,217

DATED : November 9, 1982

INVENTOR(S) : Walter E. Stone

It is certified that error appears in the above-identified patent and that said Letters Patent is hereby corrected as shown below:

On the first page, Item 56, "2,266,373 1/1941" should read --2,666,373 1/1954--.

In column 1, line 47, "housing" should read --housings--.

In column 2, line 10, "severs" should read --severe--.

In column 2, line 55, "the" (2nd occurrence) should read --The--.

In column 3, line 29, "area" should read --base--.

In column 9, line 65, "wall" should read --walls--.

In column 11, line 56, delete "said".

In column 13, line 51, delete "portions".

In column 14, line 1, delete "portions".

UNITED STATES PATENT AND TRADEMARK OFFICE

CERTIFICATE OF CORRECTION

PATENT NO. : 4,358,217

DATED : November 9, 1982

INVENTOR(S) : Walter E. Stone

It is certified that error appears in the above-identified patent and that said Letters Patent is hereby corrected as shown below:

In column 14, line 5, "portion" should read --unit--.

In column 14, line 8, delete "portion".

Signed and Sealed this

*Fifth* Day of *April 1983*

[SEAL]

*Attest:*

GERALD J. MOSSINGHOFF

*Attesting Officer*

*Commissioner of Patents and Trademarks*